US009339919B2

(12) United States Patent
Wang

(10) Patent No.: US 9,339,919 B2
(45) Date of Patent: May 17, 2016

(54) DISASSEMBLING DEVICE FOR LENS MODULE

(71) Applicant: HON HAI PRECISION INDUSTRY CO., LTD., New Taipei (TW)

(72) Inventor: Chien-Chun Wang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 320 days.

(21) Appl. No.: 13/966,301

(22) Filed: Aug. 14, 2013

(65) Prior Publication Data

US 2014/0237788 A1 Aug. 28, 2014

(30) Foreign Application Priority Data

Feb. 26, 2013 (TW) ..... 102106649 A

(51) Int. Cl.

| | |
|---|---|
| ***B21D 39/04*** | (2006.01) |
| ***B25B 27/00*** | (2006.01) |
| ***B26D 1/04*** | (2006.01) |
| ***B26D 3/28*** | (2006.01) |
| ***B26D 5/12*** | (2006.01) |
| ***B26D 7/26*** | (2006.01) |
| *B26D 1/00* | (2006.01) |

(52) U.S. Cl.

CPC . *B25B 27/00* (2013.01); *B26D 1/04* (2013.01); *B26D 3/28* (2013.01); *B26D 5/12* (2013.01); *B26D 7/2614* (2013.01); *B26D 2001/006* (2013.01); *Y10T 29/53987* (2015.01)

(58) Field of Classification Search

USPC ..... 29/282

See application file for complete search history.

(56) References Cited

U.S. PATENT DOCUMENTS

| | | | | |
|---|---|---|---|---|
| 4,099,830 | A * | 7/1978 | Whittle | B23K 26/0643 219/121.73 |
| 4,184,472 | A * | 1/1980 | Benedicto | B26D 3/28 125/23.01 |
| 2001/0045676 | A1* | 11/2001 | Winterton | B29C 37/0032 264/2.5 |
| 2009/0208197 | A1* | 8/2009 | Nomura | G03B 17/00 396/75 |
| 2011/0148129 | A1* | 6/2011 | Wang | B25B 27/00 294/86.4 |
| 2012/0182370 | A1* | 7/2012 | Kojima | B41J 2/471 347/224 |
| 2012/0321289 | A1* | 12/2012 | Hiruta | G02B 7/08 396/144 |
| 2014/0311313 | A1* | 10/2014 | Chu | G02B 7/023 83/613 |

FOREIGN PATENT DOCUMENTS

| | | | | |
|---|---|---|---|---|
| DE | 4310255 | A1 * | 10/1994 | B26D 1/547 |

* cited by examiner

*Primary Examiner* — Lee D Wilson
*Assistant Examiner* — Alvin Grant
(74) *Attorney, Agent, or Firm* — Novak Druce Connolly Bove + Quigg LLP

(57) ABSTRACT

A disassembling device for lens module which has a lens barrel and at least one optical component received in the lens barrel. The disassembling device includes a carrying platform, a cylindrical cutting tool, a cutting tool holder, and a driving device. The carrying platform includes a carrying surface for placement of the lens module. The cutting tool is arranged onto the cutting tool holder and is collinear with the lens barrel. A diameter of the cutting tool is greater than an inner diameter of the lens barrel and is less than an external diameter of the lens barrel. The driving device is connected to the cutting tool holder and moves the cutting tool holder along a central axis of the lens barrel, thereby the lens barrel can be cut and thinned by the cutting tool.

8 Claims, 4 Drawing Sheets

DISASSEMBLING DEVICE FOR LENS MODULE

BACKGROUND

1. Technical Field

The present disclosure relates to lens modules, and particularly to a disassembling device for a lens module.

2. Description of Related Art

An optical inspection is required when unapproved optical components are assembled to a lens barrel of a lens module, therefore, the unapproved optical components need to be taken out from the lens barrel for analyzation. Currently a knife is used to cut the lens barrel, and all of the optical components are removed from the lens barrel. However, an applied force of the knife to the lens barrel is difficult to control and has a low operating efficiency.

Therefore, it is desirable to provide a disassembling device that can overcome the above-mentioned problems.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Embodiments will be described with reference to the drawings.

Figure 1:
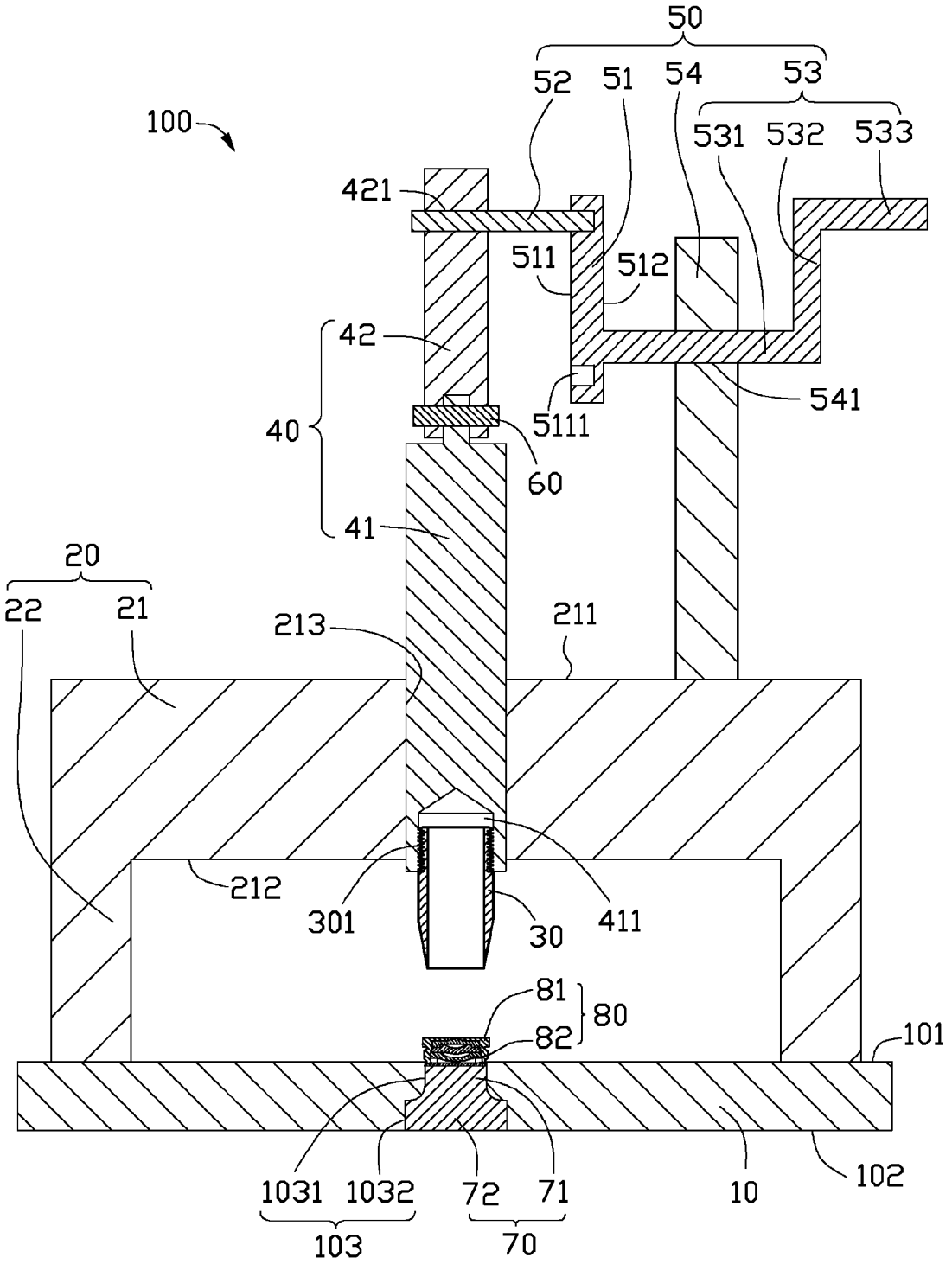
FIG. 1 is a cross sectional view of a disassembling device, according to an embodiment.
Figure 2:
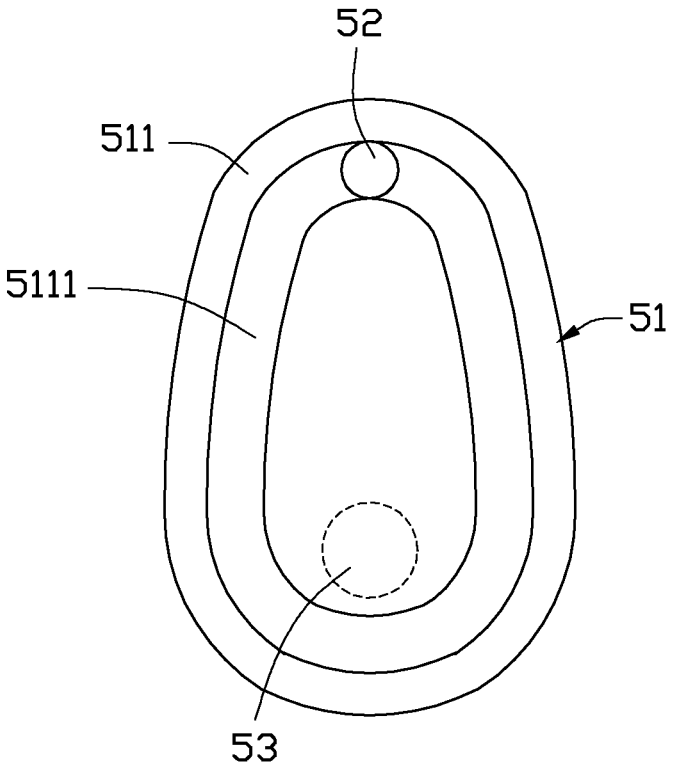
FIG. 2 is a front view of a driving device of the disassembling device of FIG.1.

FIGS. 1 to 2 show a disassembling device 100 configured to disassemble a lens module 80. The lens module 80 includes a lens barrel 81 and at least one optical component 82, such as lens or filter, received in the lens barrel 81.

The disassembling device 100 includes a carrying platform 10, a base 20, a cutting tool 30, a cutting tool holder 40, and a driving device 50.

The carrying platform 10 is substantially circular and includes a carrying surface 101 and an opposite bottom surface 102. The carrying surface 101 defines an accommodating hole 103 passing through the bottom surface 102. The accommodating hole 103 includes a first accommodating portion 1031 close to the carrying surface 101 and a second accommodating portion 1032 colinear with the first accommodating portion 1031. A diameter of the first accommodating portion 1031 is slightly less than an external diameter of the lens barrel 81. A diameter of the second accommodating portion 1032 is greater than the diameter of the first accommodating portion 1031.

The base 20 includes a top plate 21 and two side plates 22 vertically connected to both ends of the top plate 21. The top plate 21 includes an upper surface 211 and an opposite lower surface 212. The top plate 21 defines a guide hole 213 passing through the upper surface 211 and the lower surface 212. The two side plates 22 are arranged on the carrying surface 101, the lower surface 212 faces the carrying surface 101 with a space between. The guide hole 213 is colinear with the accommodating hole 103.

The cutting tool 30 is substantially a hollow cylinder, one end of the cutting tool 30 defines an external thread 301. A diameter of the cutting tool 30 is greater than an inner diameter of the lens barrel 81 but less than the external diameter of the lens barrel 81.

The cutting tool holder 40 includes a first connector 41 and a second connector 42. The first connector 41 is substantially cylindrical. A diameter of the first connector 41 corresponds to a diameter of the guide hole 213, and a length of the first connector 41 is greater than a depth of the guide hole 213. One end of the first connector 41 defines a screw hole 411. The screw hole 41 corresponds to the external thread 301. The second connector 42 is substantially a circular rod. Another end of the first connector 41 away from the screw hole 411 is rotatably connected with the second connector 42 by a plug 60. One end of the second connector 42 away from the first connector 41 defines an axle hole 421 running through the second connector 42 along radial direction. Both of the first connector 41 and the second connector 42 are perpendicular to the carrying surface 101. The first connector 41 is received in the guide hole 213 and moves axially in the guide hole 213. The cutting tool 30 is arranged onto the first connector 41 by matching the external thread 301 and the screw hole 411. The cutting tool 30 faces the carrying surface 101.

The driving device 50 includes a cam 51, a drive shaft 52, a handle 53, and a supporting plate 54. The cam 51 includes a first side 511 and a second side 512. The first side 511 defines an elliptical track groove 5111. The drive shaft 52 is substantially cylindrical. One end of the drive shaft 52 penetrates through the axle hole 421, therefore, the drive shaft 52 is fixedly connected with the second connector 42. Another end of the drive shaft 52 is received in the track groove 5111 and moves along the track groove 5111. The handle 53 and the cam 51 are integrally molded and are formed to extend from the second side 512. In another embodiment, the handle 53 and the cam 51 can be separately manufactured and assembled to the second side 512. The handle 53 is substantially Z-shaped and includes a cylindrical mating portion 531 perpendicular connected to the second side 512, an arm portion 532 perpendicular connected to the end of mating portion 531, and a holding portion 533 perpendicular connected to the end of the arm portion 532. The supporting plate 54 is arranged onto the upper surface 211 and defines a through hole 541. The mating portion 531 is rotatably received in the through hole 541.

The disassembling device 100 further includes a convex plate 70. The convex plate 70 includes a top portion 71 facing the first accommodating portion 1031 and a bottom portion 72 facing the second accommodation portion 1032. The convex plate 70 is received in the accommodating hole 103.

Figure 3:
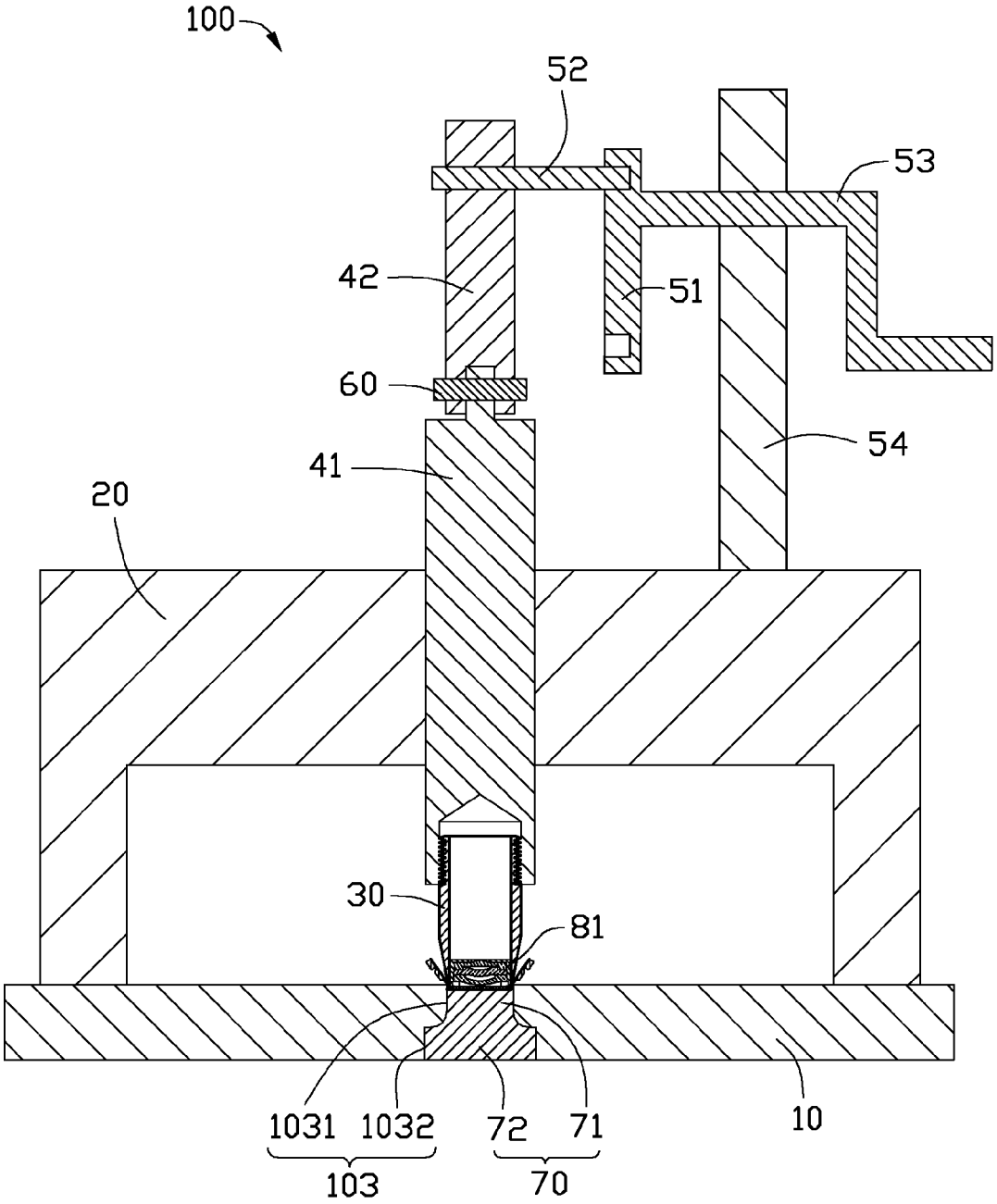
FIG. 3 is a cross sectional view of the disassembling device of the FIG. 1 in first stage of use.

Referring to FIG. 1 and FIG. 3, in use, the convex plate 70 is received in the accommodating hole 103, where the top portion 71 is slightly lower than the carrying surface 101. One end of the lens barrel 81 placed in the first accommodating portion 1031, an operator holds the holding portion 533 and rotates the handle 53 for rotating the cam 51. The drive shaft 52 is moved around the track groove 5111 and drives the second connector 42 and the first connector 41 to move along a direction perpendicular to the carrying surface 101 (i.e. a center axis of the lens barrel 81), therefore, the lens barrel 80 can be cut and thinned by the cutting tool 30. A thinned lens barrel 81 is received in the cutting tool 30. When the handle 53 is rotated and moves the cutting tool 30 away from the carrying surface 101, the thinned lens barrel 81 falls in the top portion 71 of the convex plate 70, then the operator can take away the thinned lens barrel 81.

Since the diameter of the cutting tool 30 is greater than the inner diameter of the lens barrel 81 and is less than the external diameter of the lens barrel 81, the ability of the cutting tool 30 to cut and thin the lens barrel 81 allows for easy removal of the optical element 80 from the thinned lens barrel 81. Not only is the removal efficiency improved, but damage to the optical element 82 is also prevented.

Figure 4:
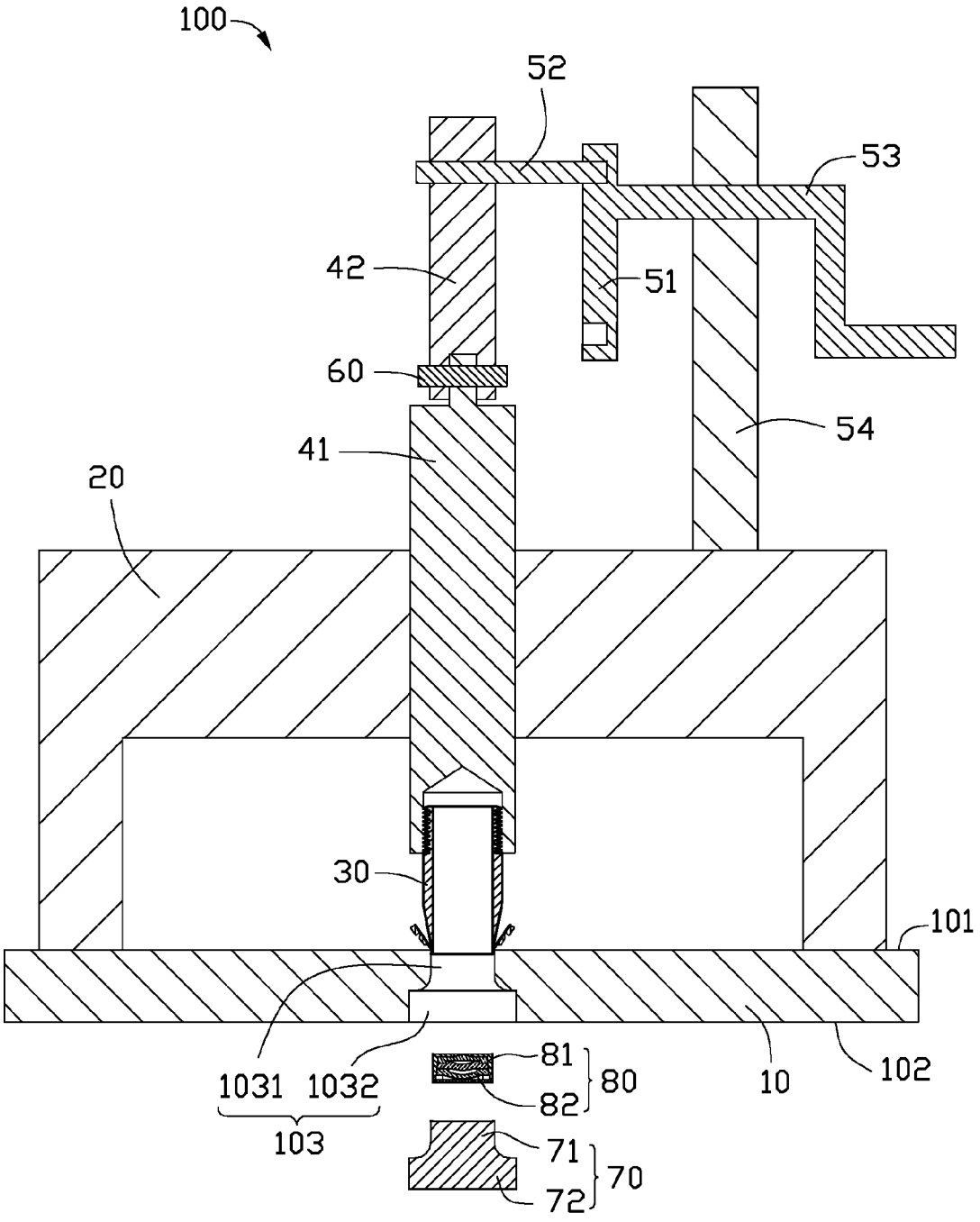
FIG. 4 is a cross sectional view of the disassembling device of FIG. 1 in second state of use.

Referring to the FIG. 4, in use, the convex plate 70 is not required to be received in the accommodating hole 103. One end of the lens barrel 81 being placed in the first accommodating portion 1031, an operator can hold the holding portion 533 and rotate the handle 53 to rotate the cam 51. The drive shaft 52 is moved around the track groove 5111 and drives the second connector 42 and the first connector 41 to move along a direction perpendicular to the carrying surface 101; in this way the lens barrel 80 can be cut and thinned by the cutting tool 30. A thinned lens barrel 81 falls into the accommodating hole 103 and falls out from the accommodating hole 103. The disassembling device 100 further includes a flexible plate opposite to the bottom surface 102 for placing the thinned lens barrel 81, then cutting can continue in relation to another lens barrel 81, further increasing the removal efficiency.

In another embodiment, the driving device 50 can be a hydraulic device, a motor, or a pneumatic device.

In another embodiment, the disassembling device 100 does not require the convex plate 70, the carrying surface 101 is not defined in the accommodating hole 103, and the lens barrel 81 is directly placed on the carrying surface 101.

The guide hole 213 of the base 20 moves the first connector 41 in a straight line. In another embodiment, the base 20 may be omitted.

In another embodiment, the carrying surface 101 defines a blind hole with a diameter slightly larger than the external diameter of the lens barrel 81, and one end of the lens barrel 81 is arranged in the blind hole.

In another embodiment, the first connector 41 and the second connector 42 are integrally formed.

Although the present disclosure has been specifically described on the basis of these exemplary embodiments, the disclosure is not to be construed as being limited thereto. Various changes or modifications may be made to the embodiments without departing from the scope and spirit of the disclosure.

What is claimed is:

1. A disassembling device for a lens module, the lens module comprising a lens barrel and at least one optical component; the disassembling device comprising:

a carrying platform comprising a carrying surface, the carrying surface configured for carrying the lens module;

a base;

a cutting tool;

a cutting tool holder; and a driving device;

wherein the cutting tool is arranged on the cutting tool holder and is collinear with the lens barrel, a diameter of the cutting tool is greater than an inner diameter of the lens barrel and is less than an external diameter of the lens barrel; the driving device is connected to the cutting tool holder and drives the cutting tool holder along a direction perpendicular to a center axis of the lens barrel, causing the cutting tool to cut the lens barrel.

2. The disassembling device as claimed in claim 1, wherein the disassembling device further comprises a base, the base comprising a top plate and two side plates vertically connected to both ends of the top plate; the top plate comprises an upper surface and an opposite lower surface; the top plate comprises a guide hole passing through the upper surface and the lower surface; the cutting tool holder received in the guide hole and moves around an axial direction of the guide hole; the two side plates arranged onto the carrying surface, the lower surface faces the carrying surface with a space between.

3. The disassembling device as claimed in claim 2, wherein the carrying surface comprises an accommodating hole for holding the lens module, and the guide hole and the accommodating hole is collinear.

4. The disassembling device as claimed in claim 3, wherein the accommodating hole passes through the bottom surface; the disassembling device further comprises a convex plate, the convex plate received in the accommodating hole.

5. The disassembling device as claimed in claim 4, wherein the accommodating hole comprises a first accommodating portion close to the carrying surface and a second accommodating portion is collinear with the first accommodating portion; a diameter of the second accommodating portion is greater than a diameter of the first accommodating portion; the convex plate comprises a top portion faces the first accommodating portion and a bottom portion faces the second accommodating portion; the top portion is slightly lower than the carrying surface.

6. The disassembling device as claimed in claim 2, wherein the driving device comprises a cam, a drive shaft, a handle, and a supporting plate; the cam comprises a first side and a second side; the first side comprises an elliptical track groove; one end of the drive shaft is fixedly connected with the cutting tool holder, another end of the drive shaft received in the track groove and moves around the track groove; the handle is formed extending from the second side; the supporting plate is arranged onto the upper surface and comprises a through hole; the handle is rotatably received in the through hole.

7. The disassembling device as claimed in claim 6, wherein the cutting tool holder comprises a first connector and a second connector, both the first connector and the second connector are substantially cylindrical; the first connector and the second connector are connected by a plug; the first connector is received in the guide hole, the second connector connected to the drive shaft.

8. The disassembling device as claimed in claim 7, wherein one end of the cutting tool has an external thread; one end of the first connector away from the second connector comprises a screw hole; the cutting tool is arranged onto the first connector by matching the external thread and the screw hole.

* * * * *